United States Patent [19]

Bjorknas

[11] 4,260,329

[45] Apr. 7, 1981

[54] PROPELLER PITCH AND ENGINE LOAD CONTROL APPARATUS

[76] Inventor: John I. Bjorknas, 2716 Panarama Dr., North Vancouver B.C., Canada

[21] Appl. No.: 11,711

[22] Filed: Feb. 12, 1979

[51] Int. Cl.[3] ..... B63H 3/08

[52] U.S. Cl. ..... 416/43; 416/49

[58] Field of Search ..... 416/31, 43, 49, 27

[56] References Cited

U.S. PATENT DOCUMENTS

| | | | |
|---|---|---|---|
| 2,878,880 | 3/1959 | Gillespie | 416/27 |
| 3,826,590 | 7/1974 | Kobelt | 416/43 X |
| 3,915,590 | 10/1975 | Bjorknas | 416/43 |

*Primary Examiner*—John M. Jillions

[57] ABSTRACT

Apparatus including series-connected pitch inching pilot valve, load control pilot valve, pressure feedback valve assembly, pitch direction selector valve, and servo power cylinder assembly. A load control bypass valve is connected in parallel with the pressure feedback valve assembly and a pitch reduction damping check valve is connected in parallel with the load control pilot valve. Counterbalancing pilot signals in the pitch inching pilot valve are received from a pressure varying manual control valve and a pitch feedback transmitter; in the load control pilot valve either from a manual load control valve and a governor load feedback valve or from each side of the pressure feedback valve assembly; in the load control bypass valve from the outlets of the inching pilot valve and the load control pilot valve. A mechanical load control override mechanism automatically places the load control pilot valve in the open to fluid pressure source position when the servo power cylinder assembly is set in the neutral propeller pitch mode by the pitch direction selector valve.

14 Claims, 2 Drawing Figures

PROPELLER PITCH AND ENGINE LOAD CONTROL APPARATUS

GENERAL DESCRIPTION

This invention relates to improvements in and developments of a propeller pitch control apparatus forming the subject of my earlier U.S. Pat. No. 3,915,590. The subject invention of U.S. Pat. No. 3,915,590 was an apparatus for controlling the pitch of a propeller of a vessel in either ahead or astern movement, while protecting the vessel engine or engines from overload due to changes in environment, changing conditions of the load in the vessel, or sudden changes of direction of movement.

The pitch control apparatus of U.S. Pat. No. 3,915,590 provided an arrangement of essential elements and components which rapidly transferred control of propeller pitch from manual inching control to automatic load control. A fuel rack position indicating transmitter of the engine provides a pilot signal which closes a load control bypass valve to prevent pitch inching control and to place the engine under automatic load control. The automatic load control pilot valve receives counterbalancing pilot signals either from both sides of a pressure feedback valve assembly, from a pitch indicating pressure feedback transmitter and a manual load control valve, or from the external load controller of the engine and the manual load control valve.

The present invention simplifies the interconnections of the elements of the apparatus disclosed in the previous patent, provides for faster transfer from pitch inching to automatic pitch control, and provides for mechanical opening of the load control pilot valve when the pitch is neutral. The simplified interconnections of elements reduce the effects and unpredictability of transient pressure variations in the control system. Faster transfer from inching to automatic pitch and load control provides improved protection against engine overload. The mechanical override of the load control pilot valve in neutral pitch ensures initial inching control for all pitch changes out of neutral pitch irrespective of transient pilot pressure variations in the load control pilot valve determined by the response times of the engine, fuel rack, and governor.

The improvements of the present invention are achieved by adding a pitch inching pilot valve which receives counterbalancing pilot signals from a manual pitch inching control valve and from a pitch feedback transmitter. In addition, a mechanical load control override assembly interconnects a pitch changing servo power cylinder assembly and the load control pilot valve. In the apparatus of U.S. Pat. No. 3,915,590, the engine load control pilot valve received its primary feedback pressure control signal from either the engine fuel rack position transmitter or from the pitch feedback transmitter, whereas in the present invention it receives its primary feedback signal from the engine fuel rack position indicator alone; the load control bypass valve received its closing signal from the engine fuel rack position transmitter, whereas in the present invention it receives its closing signal from the outlet of the pitch inching pilot valve; the load control pilot valve was opened for inching control in neutral pitch by a dominant pressure from the manual load control, as against that from the engine fuel rack position transmitter and the pitch feedback transmitter, whereas in the present invention the load control pilot valve is opened mechanically when the propeller is in neutral pitch.

Accordingly, one of the objects of the present invention is to reduce the pilot control function of the engine fuel rack position indicator from that of controlling both the load control pilot valve and the load control bypass valve to the control of the load control pilot valve alone.

A further object of the present invention is to reduce the closing and opening response times of the load control bypass valve by deriving its closing pilot signal from the hydraulic pressure between a pitch inching pilot valve and a load control pilot valve rather than from a fuel rack pneumatic position transmitter.

Another object of the present invention is to simplify and make more positive the pilot control of a load control pilot valve by deriving its pitch feedback signal from a fuel rack position transmitter alone rather than from either a fuel rack position transmitter or a pitch feedback transmitter.

Yet another object of the present invention is to provide a pitch inching pilot valve which receives counterbalancing pilot signals from a manual pitch inching command valve and a pitch indicating feedback transmitter.

Still another object of the present invention is to provide a pressure feedback valve assembly the porting of which permits ready adaptation of the rate of pitch changes and the sequence of pitch change rates to accommodate different engine, vessel, operator and control system requirements, and which also dampens pressure fluctuations arising from operation of a load control pilot valve and actuation of a pitch changing servo power cylinder assembly.

Yet a further object of the present invention is to provide a mechanical load control override assembly interconnecting a servo power cylinder assembly and a load control pilot valve, such that the load control pilot valve is automatically set in a position open to a fluid pressure source when the servo power cylinder assembly is in its neutral pitch position, thereby reliably ensuring readiness for a pitch change out of neutral irrespective of transient fluid pressures which may prevail momentarily in the pilot actuators of the load control pilot valve as a result of immediately preceding pitch changes.

These and still further objects and advantages of the present invention reside in the details of construction of a preferred embodiment disclosed herein and will be evident to one skilled in this art from a study of the specification and accompanying drawings. Therefore the preferred embodiment disclosed herein is merely exemplary and is not intended to detract from the full scope of the invention as set out in the annexed claims.

Therefore, a system according to a preferred embodiment of the present invention for controlling the pitch of a variable pitch propeller of a vessel driven by an engine having a manual load command controller for pitch control under normal engine operating conditions and an automatic propeller pitch controller for maintaining, limiting, and adjusting propeller pitch to prevent overloading the engine, comprises a pitch inching pilot valve, load control pilot valve, pressure feedback valve assembly, pitch direction selector valve, and servo power cylinder assembly, all interconnected in series to a fluid pressure source; the pitch inching pilot valve, load control pilot valve, and pitch direction selector valve are all interconnected to a fluid sump for the purpose of reducing pressure in the servo power cylinder assembly and thereby reducing pitch; a load control bypass valve interconnected in parallel with the pressure feedback valve assembly and deriving its pilot signals from each side of the load control pilot valve such that, during automatic load control, a higher pressure on the inlet side than on the outlet side of the load control pilot valve automatically closes the load control bypass valve; a pitch reduction damping check valve connected in parallel with the load control pilot valve and oriented such that the pressures in either side of the load control pilot valve may be equalized during pitch reductions resulting from a reduction of the pitch inching command signal; a pitch feedback transmitter operatively mounted on the servo power cylinder assembly to provide a pilot pressure signal which is proportional to the degree of pitch developed by the servo power cylinder assembly, this pressure signal counterbalancing the pitch inching command pilot pressure in the pitch inching pilot valve; the load control pilot valve receiving counterbalancing pilot operating signals, ultimately either from each side of the pressure feedback valve assembly or from a manual load command valve and an engine fuel rack position transmitter; the pitch direction selector valve receiving its pilot pressure signals ultimately from an ahead, neutral, and astern manual control valve; the pitch inching pilot valve being closed when the pitch command and pitch feedback pilot pressure are substantially equal, interconnecting the load control pilot valve to the fluid pressure source when the pitch command is greater than the pitch feedback pilot pressure, and interconnecting the load control pilot valve to sump when the pitch command is less than the pitch feedback pilot pressure; the load control pilot valve being closed when the load command signal ultimately from a manual control valve and a load feedback signal from a fuel rack position transmitter are substantially equal, interconnecting the pitch inching pilot valve and pressure feedback valve assembly when either the pitch is neutral, the load command pilot pressure is greater than the load feedback pilot pressure or the fluid pressure on the outlet side is greater than that on the inlet side of the pressure feedback valve assembly, and interconnecting the pitch direction selector valve to sump when the load command signal is less than the load feedback signal; the pressure feedback valve assembly interconnecting the pitch direction selector valve and the load control pilot valve to provide rates of flow and pitch change which vary with the pressure differential across the pressure feedback valve assembly; the pitch direction selector valve independently opening both ahead and astern chambers of the servo power cylinder assembly to sump when the ahead and astern command pilot pressures are atmospheric and interconnecting selectively, according to the ahead or astern command pilot pressures, either the ahead or astern portion of the servo power cylinder assembly to the load control pilot valve; a mechanical load control override interconnecting the servo power assembly and the load control pilot valve automatically to open the load control pilot valve to a fluid pressure source when propeller pitch is neutral.

More specifically, a system in accordance with the present invention, for controlling the pitch of a variable pitch propeller of a vessel driven by an engine having manual pitch, load, and direction controllers for normal engine operating conditions and an automatic load controller to prevent overloading of the engine, comprises a servo power cylinder assembly having a double-acting spring-centered piston which mechanically effects pitch changes in either of the ahead or astern directions, a pitch feedback pilot pressure transmitter mounted on the servo power cylinder assembly and actuated by a cam interconnected to the piston thereof, a normally closed three-position three-way pitch inching pilot valve which compares pitch command and pitch feedback signals and opens to a fluid pressure source to increase pitch and opens to a sump to reduce pitch, a normally closed but mechanically overriden three-position three-way load control pilot valve which compares load command and load feedback signals as well as pitch rate of change pressure feedback signals and opens to the pitch inching pilot valve to increase pitch and opens to sump to reduce pitch, a normally closed three-position three-way pressure feedback valve assembly interconnecting the load control pilot valve and a pitch direction selector valve and having an integral needle valve and orifice plug to develop a pressure differential proportional to the rate of pitch change under automatic load control and which provides secondary or damping pressure feedback pilot signals for the load control pilot valve, a normally open two-position two-way pilot actuated load control bypass valve comparing pilot fluid pressure signals from each side of the load control pilot valve and opening to permit pitch inching changes, independent of the pressure feedback valve assembly, when the load control pilot valve inlet and outlet pressures are substantially equal, and automatically closing for automatic engine load control when the load control pilot valve nears or arrives at its closed position, a check valve interconnected in parallel with the load control pilot valve to equalize pressures on inlet and outlet sides of the load control pilot valve during pitch reductions, a normally closed to fluid pressure source and open to sump three-position four-way pitch direction selector valve interconnecting each side of the servo power cylinder assembly alternatively to the pressure feedback valve assembly and load control bypass valve, as directed by an ahead or astern direction command signal, and interconnecting both sides of the servo power cylinder assembly to sump for neutral pitch, a mechanical load control override assembly interconnecting the servo power cylinder assembly and the load control pilot valve to automatically open the latter to the fluid pressure source when the servo power cylinder is in its neutral pitch position.

SCHEMATIC DESCRIPTION

An example of the present invention is illustrated in the accompanying drawings, in which like numerals refer to like parts.

Figure 1:
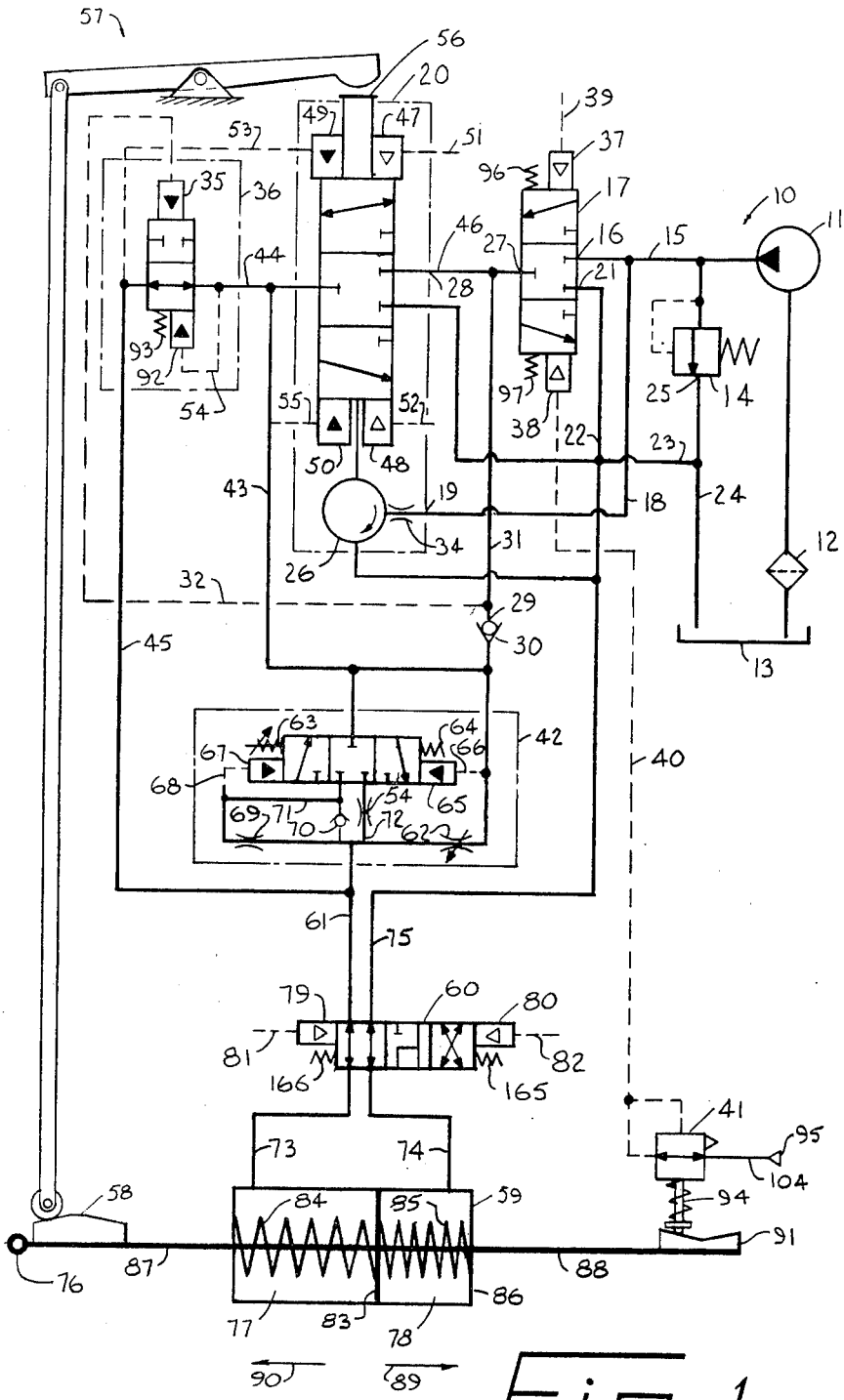
FIG. 1 is a schematic drawing illustrating the operative interconnections of the essential elements forming the substance of the present invention, using generic symbols familiar to those skilled in this art.

Referring to FIG. 1, a typical fluid pressure source 10 comprises powered pump means 11 drawing fluid through filter means 12 from sump means 13 and discharging the fluid at a maximum pressure limited by a predetermined setting in relief valve means 14. The discharged fluid from source 10 is transmitted by duct 15 to an inlet port 16 of pitch inching pilot valve means 17 and by duct 18 to port 19 of a hydraulic spool sleeve motor means 26 of load control pilot valve means 20.

Pitch inching pilot valve 17 includes an outlet port 21 interconnected to sump 13 by means of ducts 22, 23, and 24, duct 24 also interconnecting the discharge port 25 of relief valve 14 to sump 13. Pitch inching pilot valve 17 is interconnected in series to load control pilot valve 20 by duct 46 between service port 27 of pitch inching pilot valve 17 and inlet port 28 of load control pilot valve 20. Service port 27 is also interconnected to discharge port 29 of check valve means 30 by duct 31, check valve means 30 being connected in parallel with load control pilot valve 20, and by line 32 to closing pilot means 35 of load control bypass valve means 36. Pitch inching pilot valve 17 is generically a normally-closed three-position three-way pilot actuated control valve, being maintained in its normally closed position when the pilot pressures in pitch command pilot means 37 and pitch feedback pilot means 38 are substantially equal. Pilot means 37 receives a pressure signal through pilot line 39 from a normally manually operated pitch command pressure varying control valve. Pilot means 38 receives a pressure signal through pilot line 40 from a pressure varying pitch feedback transmitter means 41.

Load control pilot valve 20 is interconnected in series with pressure feedback valve assembly means 42 by duct 43 and in series with load control bypass valve 36 by ducts 44 and 45. Load control pilot valve 20 is generically a normally-closed three-position three-way pilot operated and mechanically overridden control valve assembly having its spool sleeve rotated by sleeve motor means 26 to eliminate substantially the effects of static friction on the axial movement of the valve spool. Sleeve motor 26 includes restrictor 34 in ducting 18 to control the rotational speed of the sleeve. Load control pilot valve 20 includes load command pilot means 47, load feedback pilot means 48, pitch decrease pressure pilot means 49 and pitch increase pressure pilot means 50. Pilot means 47 receives its signal through control line 51 from a normally manually operated load command pressure varying control valve or control head. Pilot means 48 receives its signal through control line 52 from an engine load feedback device, normally a pressure varying position transmitter operatively interconnected to an engine fuel rack. Pilot means 49 receives its signal through ducts 45 and 53 from the downstream side of pressure feedback valve assembly 42 and pilot means 50 receives its signal through line 55 from the upstream side of pressure feedback valve assembly 42. A mechanical override pilot means 56 automatically sets load control pilot valve 20 in its pitch-increase position, when propeller pitch is neutral, and is actuated by mechanical load control override means 57 interconnected to a high center cam means 58 on a pitch changing servo power cylinder assembly means 59. FIG. 1 illustrates servo power cylinder assembly 59 in a stable or steady-state non-neutral propeller pitch position wherein load control pilot valve 20 is not mechanically overridden. Hence equal or steady-state pressures in pilot means 47, 48, 49 and 50 effectively permit centering of load control pilot valve 20 in its normally closed position.

Pressure feedback valve assembly 42 functions under automatic load control conditions (when load control bypass valve 36 is closed) and is interconnected in series to load control pilot valve 20 and pitch direction selector valve means 60 by ducts 43, 44 and 61. Pressure feedback valve assembly 42 is generically a normally-closed three-position three-way pilot operated control valve assembly. However, an integral adjustable orifice 62 in assembly 42 provides for a controlled bleed-down or stabilizing bypass flow between valves 20 and 60. Pressure feedback valve assembly 42 is centered in its closed position by a pair of springs 63 and 64 either, neither, or both of which may be caged and adjustable to produce particular response effects desired or determined in the art by such factors as operator preference, variable pitch propeller response characteristics, vessel size and manoeuvering characteristics, and engine power, fuel demand, and speed characteristics. Pitch increase pilot means 65 receives its signal through line 66 from the upstream side and pitch decrease pilot means 67 receives its signal through line 68 from the downstream side of pressure feedback valve assembly 42.

Figure 2:
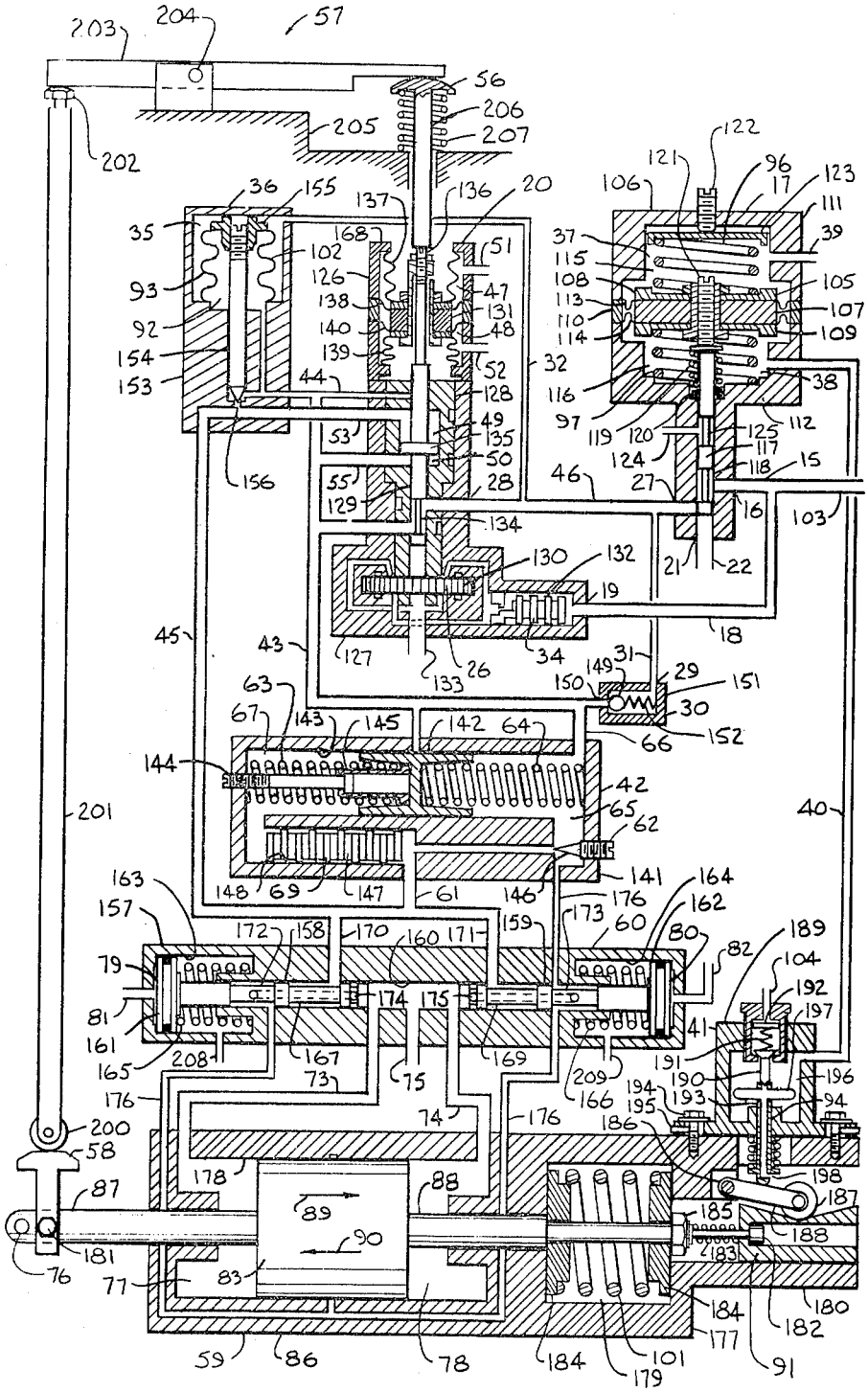
FIG. 2 is a diagramatic sectional view of the essential elements of a preferred embodiment of the present invention illustrating the internal mechanical interrelationships of the parts of the essential elements.

Again, as in the case of caging springs 63 and 64, different response times and effects may be achieved by incorporating fixed or adjustable restrictors 54 and 69, by either including or excluding a check valve bypass 70 in pressure feedback valve assembly 42, and by plugging or restricting either one of lines 71 and 72. These variations are considered to be a matter of design choice in each case. For instance, for automatic load control, FIG. 1 illustrates an embodiment wherein the initial response of pressure feedback valve assembly 42 for pitch decrease is determined by spring 64 and restrictor 69, and restrictor 62 permitting a predetermined flow or bleed bypass; the initial rate of pitch increase is determined by restrictor 62 and 69, check valve 70, and springs 63 and 64, restrictor 54 determining the ultimate rate of pitch increase once pressure feedback valve assembly 42 has shifted to its pitch increase position. FIG. 2 illustrates an embodiment wherein the initial automatic load control response for pitch decrease is determined by spring 64 (spring 63 being caged) and restrictor 69, restrictor 62 permitting a predetermined flow rate or bleed bypass and restrictor 69 determining the ultimate rate of pitch decrease when pressure feedback valve assembly 42 is in its pitch decrease open position; the initial rate of pitch increase is determined initially by springs 63 and 64 and restrictor 62 and ultimately by restrictor 62 alone even when pressure feedback valve assembly 42 is in its pitch increase position. As a preferred embodiment, the arrangement of pressure feedback valve assembly 42 illustrated in FIG. 2 has the merit of simplicity and is suitable for many variable pitch propeller and engine combinations.

Referring again to FIG. 1, pitch direction selector valve 60 is interconnected in series with load control bypass valve 36 by duct 45, with pressure feedback valve assembly 42 by duct 61, and with servo power cylinder assembly 59 by ducts 73 and 74. Duct 75 is a return line from pitch direction selector valve 60 to sump. Generically, pitch direction selector valve 60 is a normally-closed to pressure open to sump, three-position four-way pilot operated control valve assembly. Obviously, ducts 73 and 74 could control ahead and astern functions of servo power cylinder assembly 59, or vice versa, depending on the propeller pitch control mechanism to which piston rod eye 76 is interconnected. For purposes of illustration, line 73 and chamber 77 of servo power cylinder 59 will be taken as controlling ahead pitch and line 74 and chamber 78 will be considered to control astern pitch. An ahead signal is received in ahead pilot means 79 and an astern signal is received in astern pilot means 80, both of which signals are produced by a manually operated pressure varying direction control valve and conveyed to pilot means 79 and 80 by lines 81 and 82 respectively. Once an operator sets pitch direction selector valve 60 in the ahead position, as illustrated in FIG. 1, oil is free to flow into and out of chambers 77 and 78 to effect pitch changes determined by load control pilot valve 20, pitch inching pilot valve 17, and the interaction of piston 83 with centering springs 84 and 85 in servo power cylinder assembly 59. Either one or the other of pilot means 79 or 80 alone control pitch direction selector valve 60, i.e., the astern and ahead signals are not compared as between the two pilot means. Further, pitch direction selector valve 60 may be varied in design, as indicated in FIG. 2, where the generic assembly indicated in FIG. 1 is replaced by an equivalent comprising two normally-closed two-position three-way pilot operated valves having independent spools in a common sleeve and sharing a common sump return line. It is considered to be a matter of design choice in a particular case as to whether pitch direction selector valve 60 is a single valve, as illustrated in FIG. 1, a pair of valves as noted above, or a combination of elements such as is illustrated in FIG. 2.

Servo power cylinder assembly 59 is a double-acting spring centered cylinder assembly comprising in its simplest form a cylinder housing 86, a pair of springs 84 and 85, piston 83, and rod means 87 and 88 extending operatively through the ends of housing 86. Rod means 87 is interconnected to a pitch changing mechanism which is normally a portion of a variable pitch propeller assembly. Movement of piston 83 in direction 89, for purposes of illustration, effects ahead pitch and movement in direction 90 effects astern pitch. When piston 83 is centered by springs 84 and 85, propeller pitch is neutral. On rod 87 is mounted a high-center cam means 58 which controls mechanical override pilot means 56 by means of mechanical load control override 57. To rod 88 is operatively interconnected a low-center cam means 91 which controls pitch feedback transmitter 41. Movement of piston 83 is determined by the sum of the spring forces on piston 83 and the fluid pressure in each of chambers 77 and 78. Consequently, piston 83 will move in direction 89 until the fluid pressure in chamber 77 offsets the force of spring 85 less that of spring 84; piston 83 will move in direction 90 until fluid pressure in chamber 78 offsets the force of spring 84 less that of spring 85. Movement of cam 58 in either direction from neutral eliminates the mechanical override of load control pilot valve 20; cam 91 and transmitter 41 provide a pitch feedback pressure signal of intensity proportional to the degree of movement of piston 83 out of neutral and the related and dependent degree of pitch developed in a variable pitch propeller.

Load control bypass valve 36 determines whether or not control of pitch by pitch inching pilot valve 17 and load control pilot valve 20 bypasses pressure feedback valve assembly 42. Load control bypass valve 36 is interconnected in parallel with pressure feedback valve assembly 42 and in series with load control pilot valve 20 and pitch direction selector valve 60. Generically, load control bypass valve 36 is a normally-open two-position two-way pilot operated control valve. It receives its closing signal at pilot means 35 from the service port of pitch inching pilot valve 17 and its normally-open pilot signal at pilot means 92 by means of duct 54 from duct 44. For normal inching control of propeller pitch, within the load command or permitted load limits of the engine, load control pilot valve 20 will be open to flow from pitch inching pilot valve 17 and the pressures in pilot means 35 and 92 will be substantially equal, thus permitting spring 93 to maintain load control bypass valve 36 in the normally open position. Hence, fluid from pitch inching pilot valve 17 will bypass pressure feedback valve assembly 42 and flow through pitch direction selector valve 60 into either one of chambers 77 or 78 of servo power cylinder assembly 59, as predetermined by a vessel operator. Once the predetermined engine load limit is approached by increasing propeller pitch, the pilot pressures in pilot means 47 and 48 approach equality and load control pilot valve 20 commences to close, thus creating a pressure differential between pilot means 35 and 92, whereby load control bypass valve 36 closes and further fluid flow into servo power cylinder assembly 59 must pass through pressure feedback valve assembly 42. Alternatively, a pitch decrease commanded by pitch inching pilot valve 17 will reduce the pressure in pilot means 35, thereby permitting fluid flow from servo power cylinder assembly 59 to bypass pressure feedback valve assembly 42, thus effecting a rapid pitch decrease; in this case, the pressure drop across load control pilot valve 20 is compensated for by check valve 30 to ensure immediate closing of load control bypass valve 36 and return to automatic load control if required by the vessel operator.

Finally, pitch feedback transmittor 41 is in effect a pressure regulator or pressure varying valve which produces a signal pressure proportional to the axial movement of stem 94 but limited to the maximum pressure of source 95. The movement of stem 94 is determined by the shape of cam 91 and the degree of movement of piston 83 and rod 88. Similar pneumatic pressure transmitter devices are normally used to produce a feedback signal from a fuel rack position indicator, a manual load command control head, a manual pitch inching command control head and other such pressure varying controls. Hence, one might generalize by saying that control pilot signals, if pneumatic, customarily originate in a pressure regulator type of device, similar to the pitch feedback transmitter 41 and familiar to those skilled in this art, for valve pilot means 37, 38, 47 and 48.

MECHANICAL DESCRIPTION

Turning now to FIG. 2, the mechanical structure of the elements of one embodiment of this invention may be described. First, however, the embodiment of FIG. 2 differs slightly from that of FIG. 1 for purposes of illustrating obvious choices of design available to those skilled in this art. For instance, the pair of springs 84 and 85 in servo power cylinder assembly 59 are replaced in FIG. 2 by a single spring means 101 which serves to provide a uniform and consistent spring force in either direction of movement of piston 83. Ducts 66, 68, 71, and 72 in FIG. 2 are incorporated into the internal structure and cavities of pressure feedback valve assembly 42. Check valve 70 and restrictor 54 are excluded and duct 72 effectively blocked in FIG. 2 to illustrate one of many ducting options for pressure feedback valve assembly 42 available to skilled users of this invention. Bellows 102 effectively serves the dual functions of spring 93 and the separation of pilot means 35 and 92. The pressure sources in FIG. 2 are not shown but may be taken, for purposes of illustration, as a hydraulic fluid and pressure in duct 103 and a pneumatic fluid and pressure in duct 104. FIG. 1 shows the apparatus in a non-neutral configuration with an ahead signal in pitch direction selector valve pilot 79 whereas FIG. 2 shows the apparatus in its neutral pitch with load control pilot valve 20 maintained open by mechanical override pilot means 56.

Pitch inching pilot valve 17 comprises balancing pilot piston portion 105 and housing portion 106. Piston 105 is centered in housing 106 by springs 96 and 97, and comprises core 107 and flanges 108 and 109 operatively secured together. Housing 106 comprises a center piece 110, command end 111, and spool end 112 operatively secured together. A pair of diaphragms 113 and 114 are operatively clamped between core 107 and flanges 108 and 109, as well as between center piece 110 and housing ends 111 and 112, forming pneumatic pilot command chamber 115 and pneumatic pilot feedback chamber 116. Springs 96 and 97 center piston 105 when the pneumatic pressures in chambers 113 and 114 are substantially equal. Valve spool 117 is slidably mounted in cylinder portion 118 of housing spool end 112, held against piston 105 by spool spring means 119, and circumferentially sealed as between chamber 116 and spool cylinder 118 by sealing means 120. The axial relationship between spool 117 and piston 105 may be adjusted by adjusting means 121 threaded and operatively sealed in piston 105. Positioning piston 105 and spool 117 in housing 106, when the pressures in chambers 114 and 115 are equal, may be accomplished by adjusting means 122, operatively threaded and sealed in housing end 111, and acting against spring caging disc 123. Duct 124 relieves fluid leakage past recessed spool portion 125.

Load control pilot valve 20 comprises a pilot portion 126, a housing portion 127, a sleeve portion 128, a spool portion 129, and sleeve motor portion 26. Sleeve 128 is rotatably mounted in housing 127 and rotated by impeller portion 130 of sleeve motor 26; spool 129 is secured against rotation by its interconnection to piston 131 of pilot assembly 126. The rotational speed of sleeve 128 is governed by orifice plug 132 and discharge from motor 26 returns to sump through return duct 133. Spool 129 includes recessed portion 134, pilot piston 135 separating pilot chambers 49 and 50, and adjusting stem 136 operatively secured to pilot piston 131. Pilot piston 131 and pilot housing 168 comprise structure which effectively secures and seals pilot chamber 47 by means of bellows 137 and diaphragm 138 and pilot chamber 48 by means of bellows 139 and diaphragm 140, all of which structure is a matter of design choice readily apparent to those skilled in this art.

Pressure feedback valve assembly 42 comprises housing portion 141 and pilot piston portion 142 operatively centered in housing cylinder portion 143 by springs 63 and 64. Spring 63 is caged to prevent extension by adjusting means 144 operatively threaded and sealed in housing 141 and upon which is slidably mounted caging sleeve 145. A variable restrictor 62 comprises a needle valve 146 operatively threaded and sealed in housing 141. Fixed restrictor 69 comprises an orifice plug 147 operatively mounted in housing cylinder portion 148.

Check valve 30 comprises a ball means 149 seated in port 150 of housing 151 by spring 152.

Load control bypass valve 36 comprises housing portion 153 and needle spool portion 154 maintained in its normally open position by bellows 102. Bellows 102 separates closing and opening pilot chambers 35 and 92. Adjusting nut 155 threadably mounted and sealed on the back end of spool 154 permits adjustment of the opening and fluid flow rate at orifice 156 when load control bypass valve 36 is normally open.

Pitch direction selector valve 60 comprises housing portion 157 and a pair of spool portions 158 and 159 sharing and slidably mounted in a common cylinder portion 160 of housing 157. Operatively secured to the outer ends of spools 158 and 159 are pilot pistons 161 and 162 sealed for axial movement in cylinder portions 163 and 164 of housing 157. Springs 165 and 166 hold pistons 161 and 162 against the ends of housing 157 and, thereby, spools 158 and 159 in their normally closed to source open to sump positions. Spool recesses 167 and 169 permit flow from either duct 170 or 171 into duct 73 or 74 when, selectively, a pilot pressure against either piston 161 or 162 operatively overcomes the force of spring 165 or 166. Spool recesses 172 and 173, spool porting 174 and 175, and ducting 176 equalize pressures between servo power cylinder assembly 59, pressure feedback valve assembly 42, and pitch direction selector valve 60 which might arise under steady state conditions because of internal leakage or temperature changes. Ducts 208 and 209 drain the spring chambers of pitch direction selector valve 60 to tank.

Servo power cylinder assembly 59 comprises housing portion 177, piston portion 83, and centering spring 101. Housing 177 includes cylinder portion 178, centering spring chamber 179, and pitch feedback pressure transmitter mounting portion 180. Piston portion 83 is interconnected to pitch changing actuator rod 87 and feedback rod 88. Cam 58 is slidably mounted on rod 87 and secured by bolt 181. Low center cam 91 is adjustably secured to the end of rod 88 by bolt 182 and spring 183 and slidably mounted in housing portion 180. Spring 101 is cage in chamber 179 by a pair of plates 184 slidably mounted on a recessed portion of rod 88 and secured by nut 185. Cam follower 186 comprises roller 187 rotably mounted on one end of lever 188, the latter being pivotally mounted in housing portion 180.

Pitch feedback transmitter 41 comprises housing portion 189, valve stem 190, stem closing spring 191, inlet filter 192, and spring returned bellows actuator 193. Housing 189 is slidably adjustable on housing 177 by mounting bolts 194 and adjusting screws 195. Upward movement of stem 193 unseats the upper portion of stem 190, permitting flow of air into chamber 196 and duct 40 until the pressure in chamber 196 becomes sufficient to compress bellows 197 and reseat the top portion of stem 190. Downward movement of stem 193 unseats the lower portion of stem 190, allowing pressure in chamber 196 to be relieved through duct 198 in stem 193 until bellows 197 expands to reseat the lower end of stem 190. Upward movement of stem 193 is proportional to pitch increase and downward movement is proportional to pitch decrease.

Mechanical load control override 57 comprises high-center cam 58, cam follower roller 200, first rod means 201 having a length adjusting means 202 at its upper end bearing on the underside of one end of a lever means 203, lever 203 pivotally mounted on a fulcrum means 204 which is operatively secured to the same base 205 as is load control pilot valve 20, and a second rod means 206 bearing on the underside of the other end of lever 203, rod 206 being slidably mounted for actuation along the axis of spool 129 and spring returned by spring 207 caged between base 205 and one end of rod 206.

Having described above the structure of the present invention, it is now possible, with reference to both of FIGS. 1 and 2, to consider the operation of the apparatus of the present invention in permitting manual propeller pitch inching control with automatic engine load control.

PROPELLER PITCH INCHING CONTROL

Coincident with the operation of a vessel engine, a hydraulic pump 11 is normally powered and thereby provides a flow of hydraulic fluid in duct 15 according to the pump size and speed and at a maximum pressure determined by relief valve 14. A portion of this fluid turns spool sleeve motor 26 at a speed determined by orifice plug 34 and the pressure in duct 15, which varies with the opening and closing of pitch inching pilot valve 17 and the degree of movement of piston 83 in servo power cylinder assembly 59.

Consider a starting point wherein a variable pitch propeller is in neutral pitch, pitch inching pilot valve 17 is closed, load control pilot valve 20 is open to pitch inching pilot valve 17, load control bypass valve 36 is open, piston 142 in pressure feedback valve assembly 42 is centered, pitch direction selector valve 60 is closed to pressure feedback valve assembly 42 and is open as between both sides of piston 83 in servo power cylinder assembly 59 and sump, all generally as indicated in FIG. 2. Pneumatic command pilot pressure in chamber 37 and feedback pilot pressure in chamber 38 of pitch inching pilot valve 17 are substantially equal, i.e., atmospheric pressure. Pneumatic load command pilot pressure in chamber 47 and engine feedback pilot pressure in chamber 48 of load control pilot valve 20 may or may not be substantially equal but mechanical load control override 57 maintains spool 129 in the open position to pitch inching pilot valve 17. Hydraulic pilot pressures in chambers 49 and 50 of load control pilot valve 20 are equal and hydraulic pilot pressures in chambers 35 and 92 of load control bypass valve 36 are also equal, load control bypass valve 36 being open to bypass impending flow around pressure feedback valve assembly 42 and between load control pilot valve 20 and pitch direction selector valve 60. The hydraulic pilot pressures on both sides of piston 142 of pressure feedback valve assembly 42 are equal, as are hydraulic pressures on each side of piston 83 in servo power cylinder assembly 59.

Consider now that the vessel engine is running at a speed determined by a load command signal which is sensed in chamber 47 of load control pilot valve 20. This signal pilot pressure will be greater than the load feedback signal received in chamber 48 from a fuel rack position transmitter. Hence load control pilot valve 20 will remain open under a given load command and at zero pitch, irrespective of actuation by mechanical load control override 57. Having thus established an engine speed, a vessel operator may now select his direction of travel, say ahead, by manually actuating a pneumatic control valve which establishes pilot pressure in pitch direction selector valve 60 pilot portion 79, thus interconnecting ducts 73 and 170 and leaving duct 74 interconnected to sump. Now the operator may commence to set propeller pitch by establishing a pilot pressure in chamber 37 of pitch inching pilot valve 17 which is proportional to the degree of pitch desired. Spool 117 of pitch inching pilot valve 17 will move downward and permit hydraulic fluid flow between pump 11 and load control pilot valve 20, through load control bypass valve 36, pitch direction selector valve 60 and into chamber 77 of servo power cylinder assembly 59, flow from chamber 78 being conveyed to sump via duct 75. Once rod 88 moves the desired amount in direction 89, cam 91 depresses spool 94 of pitch feedback transmitter 41 whereby the pressure in duct 40 approaches that in duct 39; the pilot pressures then becoming substantially equal in pilots 37 and 38 of pitch inching pilot valve 17 and pitch inching pilot valve 17 once again closing to prevent further flow from pump 11 to load control pilot valve 20. Conversely, should the pitch command signal be set at less that that received from pitch feedback transmitter 41, spool 117 will shift upward, opening duct 26 to duct 75 and chamber 78. In this way, propeller pitch may be increased or decreased, in either pitch direction set by pitch direction selector valve 60, within the load limits of an engine, as determined by a load command pilot signal in chamber 48 of load control pilot valve 20, with hydraulic flow passing in either direction through load control bypass valve 36 and bypassing pressure feedback valve assembly 42. Provided that the inching or manually set pitch is less than would exceed the permitted engine load at its preset speed, the load feedback pilot signal pressure will be lower than the load command pilot pressure and spool 129 of load control pilot valve 20 will remain in the open to pitch inching pilot valve 17 position illustrated in FIG. 2.

It will be apparent from a study of FIGS. 1 and 2 that a crash reversal may be achieved at given pitch and load command settings in pitch inching pilot valve 17 and load control pilot valve 20 by shifting pilot pressure in pitch direction selector valve 60 from one of pilot actuators 79 and 80 to the other. It will also be apparent that the pilot pressures in chambers 37 of pitch inching pilot valve 17 and 47 of load control pilot valve 20 may be derived either from a single pressure varying valve, provided sufficient mechanical adjustment in pitch inching pilot valve 17 is allowed to match command pitch to command load under optimum vessel operating conditions, from a pair of pressure varying valves actuated manually either singly or jointly by a pair of control head levers, an adjustment in output signal pressures therebetween permitting a practical matching of optimum command pitch to command load, or from a pair of independently operated manual pressure varying control valves. The selection of manual control valves to provide load command and pitch command is considered to be an obvious design choice in each case, although a pair of valves actuated singly or jointly by a pair of adjacent levers is a practical and economical choice in many engine/propeller applications.

It will be apparent from the foregoing description that, during pitch inching manual control, load control pilot valve 20 and pressure feedback valve assembly 42 are substantially redundant as long as the propeller pitch and actual engine load remain lower than the command or allowable engine load. It is either when optimum engine operating conditions are desired over a prolonged period or when marine conditions, wind direction, vessel direction, and other such factors are altered whereby the optimum propeller pitch for a given engine speed and command load generates an actual engine load greater than the allowable, that load control pilot valve 20 and pressure feedback valve assembly 42 intercede automatically be means of load control bypass valve 36 to control propeller pitch and maintain an optimum or allowable engine load.

AUTOMATIC ENGINE LOAD CONTROL

Consider a case in which a vessel operator sets a propeller pitch direction and magnitude by means of pitch direction selector valve 60 and pitch inching pilot valve 17 respectively, and operating engine command load and speed by means of an engine governor. Under such a steady-state condition, the apparatus of the present invention is illustrated schematically in FIG. 1. Pitch inching pilot valve 17 is closed to flow in either direction, the pitch command pilot pressure in chamber 37 being balanced by the pitch feedback pressure in chamber 38. Load control pilot valve 20 is closed to flow in either direction, the pneumatic load command pilot pressure in chamber 47 being balanced by the pneumatic load feedback pressure in chamber 48, the mechanical load control override 57 being operatively released, and the hydraulic pilot pressures in chambers 49 and 50 being substantially equalized across pressure feedback valve assembly 42 under steady-state conditions.

Consider now that the wind resistance of the vessel increases. To maintain a constant engine speed, the engine fuel rack will demand more fuel and a fuel rack position indicating transmitter will increase the pilot pressure in chamber 48 of load control pilot valve 20. Accordingly, spool 129 will move upward and hydraulic fluid from chamber 77 of servo power cylinder assembly 59 will flow back through pitch direction selector valve 60, load control bypass valve 36, and load control pilot valve 20 into chamber 78 via duct 75. However, removal of oil from chamber 77 decreases pitch, automatically reducing the load on the engine and the fuel demand pilot pressure in chamber 48 of load control pilot valve 20. Meanwhile, movement of piston 83 and cam 91 causes a reduction in pilot pressure generated by pitch feedback transmitter 41 and causes pitch inching pilot valve 17 to open to pressure source 10. Increased pressure in duct 46 produces a pilot signal, via line 32, in pilot chamber 35 which closes load control bypass valve 36. Hence, the rapid pitch decrease which was effected by flow through load control bypass valve 36 is suddenly stopped and the pressures in ducts 43 and 61 must equalize through pressure feedback valve assembly 42.

Referring now to FIGS. 1 and 2, if the hydraulic pressure in duct 61 is great enough, pilot pressure in chamber 67 will move pilot piston 142 to the left against spring 64, thereby opening duct 71 to duct 43 for a continued rapid second stage pitch decrease governed by orifice plug 69; otherwise the pitch decrease will terminate through needle valve 62. Further, closing load control bypass valve 36 creates a greater pressure in duct 45 than in duct 43, thus creating a pilot pressure imbalance between chambers 50 and 49 which counters the imbalance in chambers 47 and 48 of load control pilot valve 20; hence, whereas a load feedback signal in chamber 48 demands reduced pitch, the closing of load control bypass valve 36 creates a feedback pilot pressure in chamber 49 which dampens and prevents overshooting of the required pitch change. Once the pressures in ducts 43 and 61 approach each other, pressure feedback valve assembly 42 closes (if it had opened) and the pressures continue to stabilize through needle valve 62. Load control pilot valve 20 once again assumes its closed or steady state condition, although pitch inching pilot valve 17 will remain open to pump 11 because the increased wind resistance has resulted in a propeller pitch and pitch feedback signal lower in intensity than the pitch command signal. During rapid pitch decreases effected by pitch inching pilot valve 17, pressures in ducts 26 and 24 are equalized by check valve 30 to ensure substantially instantaneous response of load control bypass valve 36 when automatic load control is resumed.

Assume now that the wind resistance gradually reduces substantially to restore optimum vessel operating conditions. The fuel rack position indicator transmitter reduces the pilot pressure in chamber 48 of load control pilot valve 20 such that spool 129 moves downward to open duct 44 to duct 46. If the change is gradual, the pressure in duct 46 will remain higher than that in duct 44, thus keeping load control bypass valve 36 closed and effecting a pitch increase through pressure feedback valve assembly 42. The initial pitch increase will be accomplished by hydraulic fluid flow into chamber 77 of servo power cylinder assembly 59 through needle valve 62 and from chamber 67 through check valve 70 and orifice 69 (FIG. 1) or through orifice 69 alone (FIG. 2). Flow from chamber 78 of servo power cylinder assembly 59 will flow to sump through duct 75. It will be apparent to those skilled in this art that the rate of response for pitch increases and decreases will depend on the combination of fixed orifices, variable orifices, check valves, and caged and uncaged centering springs embodied in the structure of pressure feedback valve assembly 42. Clearly, the essential function of pressure feedback valve assembly 42 is to produce a damping pressure feedback signal to pilot chambers 49 and 50, whereby to prevent overshooting of required pitch changes, and the timing and sequential effects of various combinations of orifices, check valves, and springs are considered to be a matter or design choice well within the intellectual ambit of those skilled in this art relative to engine characteristics, variable pitch propeller characteristics, vessel manoeuvering characteristics, and operator preferences.

Steady-state or non-neutral established propeller pitch may be reduced manually in three ways. The first is by reducing the pitch command signal in chamber 37 of pitch inching pilot valve 17, fluid from servo power cylinder assembly 59 is transferred from one side to the other of piston 83 by way of ducts 22 and 75. The second is by reducing the load command signal in chamber 47 of load control pilot valve 20; fluid from servo power cylinder assembly 59 will again be transferred from one side to the other of piston 83 by ducts 22 and 75. The third is by balancing or reducing the pressure in direction selector valve pilot chambers 79 and 80 to atmospheric; fluid from servo power cylinder assembly 59 is again transferred through ducts 73 and 74 from one side to the other of piston 83.

When pitch is neutral, pressures in chambers 37 and 38 of pitch inching pilot valve 17 being equal, mechanical load control override 57 overrides any preset or transient pilot signals which might prevail in either of chambers 47, 48, 49 and 50 of load control pilot valve 20. This places load control pilot valve 20 in its open to pitch inching pilot valve 17 condition in immediate readiness for a pitch change. This feature is particularly useful in active maneouvering or crash reversals of a vessel.

It is believed that my invention of an apparatus for manually controlling variable propeller pitch and automatically controlling engine load in a vessel will have been clearly understood from the foregoing detailed description of my now preferred and illustrated embodiment. Various modifications, changes, additions, and equivalents may be resorted to in view of these teachings by one skilled in this art without departing from the spirit of my invention. For example, mechanical load control override 57 may comprise any number of operative combinations of links, levers, cams, and rods. By employing a shuttle valve interconnecting load feedback signals from a pair of engines, a pair of engines may be controlled by a single propeller pitch and engine load control apparatus. Many types of pressure regulator devices may be employed as a pressure feedback transmitter 41 and to produce a fuel rack load feedback signal in chamber 48 of load control pilot valve 20. Therefore, the present invention is not to be construed as limited to the specific details of the apparatus illustrated schematically and diagrammatically herein, and whereas a choice between variations, modifications, changes, additions, and equivalents falling within the true scope of my invention will depend largely upon the circumstances in which it is used, it is my express intention that no limitations be implied and that hereto annexed claims be given the broadest interpretation to which the language fairly admits.

I claim:

1. An apparatus, for automatically controlling the load on an engine in a vessel by controlling the pitch of a variable pitch propeller, comprising a pitch inching pilot valve, a load control pilot valve, a pressure feedback valve assembly, pitch direction selector valve, a servo power cylinder assembly, said pitch inching pilot valve and load control pilot valve and pressure feedback valve assembly and pitch direction selector valve and servo power cylinder assembly operatively connected in series to a fluid pressure source, said pitch inching pilot valve and load control pilot valve and pitch direction selector valve operatively connected to a fluid sump, a load control bypass valve operatively connected in parallel with said pressure feedback valve assembly and receiving pilot control signals from opposite sides of said load control pilot valve, whereby said load control bypass valve alternatively opens to permit manual pitch control by said pitch inching pilot valve and closes to provide automatic load control by said load control pilot valve and said pressure feedback valve assembly.

2. An apparatus as defined in claim 1 and further including a pitch-reduction damping check valve connected in parallel with said load control pilot valve, said check valve oriented and interconnected to prevent flow from said pressure inching pilot valve to said pressure feedback valve assembly and to permit flow and pressure equalization between the inlet of said pressure feedback valve assembly and the inlet of said load control pilot valve during pitch decreases.

3. An apparatus as defined in claim 1 wherein said servo power cylinder assembly further includes a cylinder portion and a spring-centered double-acting piston portion, said piston portion interconnected at one end to a propeller pitch control means and at its other end to a pitch indicator cam means, said pitch inching pilot valve having first and second pilot acutation means, a fluid pressure pitch feedback transmitter valve operatively mounted on said cylinder portion and mechanically interconnected to said cam means, fluid pressure from said pitch feedback transmitter being proportional to the position of said piston portion and cam means relative to said cylinder portion, counterbalancing fluid pressure signals in said first and second pilot acutation means being received respectively from a manual pressure varying pitch command valve and from said pitch feedback transmitter, said pitch inching pilot valve being closed when fluid pressures in said first and second pilot actuation means are equal and open to said fluid pressure source when pressure in said first pilot actuation means is greater than that in said second pilot actuation means and open to said fluid sump when pressure in said second pilot actuation means is greater than that in said first pilot actuation means.

4. An apparatus as defined in claim 3 wherein the position of said pitch feedback transmitter relative to said cam means may be changed by cam adjusting means interconnecting said cam means to said piston portion.

5. An apparatus as defined in claim 3 wherein the position of said pitch feedback transmitter relative to said cam means may be changed by transmitter adjusting means interconnecting said pitch feedback transmitter relative to said cylinder portion.

6. An apparatus as defined in claim 1 wherein said servo power cylinder assembly includes a cylinder portion and a piston portion, said piston portion interconnected at one end to a mechanical cam means, a mechanical load control override means interconnecting said cam means and said load control pilot valve, said mechanical load control override opening said load control pilot valve to fluid flow from said pitch inching pilot valve when said servo power cylinder assembly is in its neutral pitch position.

7. An apparatus as defined in claim 6 wherein said mechanical cam means is slidably adjustable with respect to said piston portion.

8. An apparatus as defined in claim 6 wherein said mechanical load control override means includes a cam follower, rotatably mounted on one end of a first push rod having length adjusting means at its other end, a fulcrum means secured ultimately to the same base as said load control pilot valve, a spring-returned second push rod slidably mounted for actuation substantially on the spool axis of said load control pilot valve, a lever means pivotally supported on said fulcrum means and operatively connected to said first and second push rods.

9. An apparatus as defined in claim 1 wherein said pressure feedback valve assembly includes a pilot piston positioned in a housing assembly by a pair of springs, said housing assembly including a needle valve and an orifice plug, a pair of bypass ports normally closed by said pilot piston, said load control bypass valve being operatively closed for automatic load control, said pair of springs and said needle valve and said orifice plug determining an initial rate of pitch increase and opening of said bypass ports by said pilot piston permitting a substantially unrestricted rate of prolonged pitch increase, said pair of springs and said needle valve and said orifice plug determining an initial rate of pitch decrease and opening of said bypass ports by said pilot piston permitting a substantially unrestricted rate of prolonged pitch decrease.

10. An apparatus as defined in claim 1, wherein said pitch feedback valve assembly includes a pilot piston positioned in a housing assembly by a pair of springs, said housing assembly including a needle valve and an orifice plug, a bypass port on the inlet side of said pressure feedback valve assembly and normally closed by said pilot piston, said load control bypass valve being operatively closed for automatic load control, said pair of springs and said needle valve and said orifice plug determining an initial rate of pitch increase and said needle valve alone determining a prolonged rate of pitch increase, said pair of springs and said needle valve and said orifice plug determining an initial rate of pitch decrease and opening of said bypass port by said pilot piston permitting a rate of pitch decrease which is determined by said orifice plug and said needle valve.

11. An apparatus as defined in claim 1, wherein said pressure feedback valve ssembly includes a pilot piston positioned in a housing assembly by first and second springs, said first spring being caged to permit compression and to prevent extension thereof, said load control bypass valve being operatively closed for automatic load control, said first and second springs affecting an inital rate of pitch increase and said second spring alone affecting an initial rate of pitch decrease.

12. An apparatus as defined in claim 1, wherein said pressure feedback valve assembly includes a pilot piston positioned in a housing assembly by first and second springs, said housing assembly including a needle valve and an orifice plug, a bypass port on the inlet side of said pressure feedback valve assembly and normally closed by said pilot piston, said first spring being caged to permit compression and to prevent extension thereof, said load control bypass valve being operatively closed for automatic load control, said first and second springs and said needle valve and said orifice plug determining an initial rate of pitch increase and said needle valve alone determining a prolonged rate of pitch increase, said second spring and said needle valve and said orifice plug determining an initial rate of pitch decrease and opening of said bypass port by said pilot piston permitting a prolonged rate of pitch decrease which is determined by said needle valve and said orifice plug.

13. An apparatus as defined in claim 1, wherein said pressure feedback valve assembly includes a pilot piston positioned in a housing assembly by first and second springs, said housing assembly including a needle valve and an orifice plug and a check valve, said second spring being caged to permit compression and prevent extension thereof, a bypass port on the inlet side of said pressure feedback valve assembly and normally closed by said pilot piston, said load control bypass valve being operatively closed for automatic load control, said first spring and said needle valve and said orifice plug and said check valve determining an initial rate of pitch increase and said needle valve alone determining a prolonged rate of pitch increase, said first and second springs and said needle valve and said orifice plug determining an initial rate of pitch decrease and opening of said bypass port by said pilot piston permitting a rate of pitch decrease dependent on said orifice plug and said needle valve.

14. An apparatus for automatically controlling the load on an engine in a vessel by controlling the pitch of a variable pitch propeller and comprising a pitch inching pilot valve, a load control pilot valve, a pressure feedback valve assembly, a pitch direction selector valve, a servo power cylinder assembly, said pitch inching pilot valve and load control pilot valve and pressure feedback valve assembly and pitch direction control valve and servo power cylinder assembly operatively connected in series with a fluid pressure source, a load control bypass valve connected in parallel with said pressure feedback valve assembly, a pitch reduction damping check valve connected in parallel with said load control pilot valve, said pitch inching pilot valve and load control pilot valve and pitch direction selector valve operatively connected to a fluid sump, a pitch feedback transmitter interconnected to said servo power cylinder assembly, said pitch inching pilot valve receiving counterbalancing pilot pressure signals from a manual fluid pressure control valve and from said pitch feedback transmitter, said load control pilot valve receiving counterbalancing pilot pressure signals either from a manual fluid pressure control valve and an engine load feedback fluid pressure control valve or from opposite sides of said pressure feedback valve assembly, said load control bypass valve receiving counterbalancing pilot pressure signals from opposite sides of said load control pilot valve, said pressure feedback valve assembly receiving counterbalancing pilot pressure signals from opposite sides of itself, said pitch direction selector valve receiving pilot control signals from a manual ahead and astern fluid control valve, a mechanical load control override means interconnecting said load control pilot valve and said servo power cylinder assembly, whereby said pitch inching pilot valve controls pitch changes when said load control bypass valve is open, said pressure feedback valve assembly and said load control pilot valve control pitch changes and rates of change when said load control bypass valve is closed, and said mechanical load control override automatically places said load control pilot valve in its open position when said servo power cylinder is in its neutral pitch position.

* * * * *